United States Patent [19]

Werner et al.

[11] Patent Number: 4,700,492

[45] Date of Patent: Oct. 20, 1987

[54] AIR ACTUATED AUTOMATIC LINT SCREEN CLEANING SYSTEM FOR DRYER

[75] Inventors: Kurt Werner, St. Joseph Township, Berrien County; Gregory L. Malchow; Keith E. Carr, both of Lincoln Township, Berrien County; Robert A. Brenner, St. Joseph Township, Berrien County, all of Mich.

[73] Assignee: Whirlpool Corporation, Benton Harbor, Mich.

[21] Appl. No.: 826,181

[22] Filed: Feb. 5, 1986

[51] Int. Cl.[4] ..... F26B 3/04; F26B 21/02

[52] U.S. Cl. ..... 34/32; 34/82; 34/85; 55/294

[58] Field of Search ..... 34/82, 85, 133, 32; 55/294

[56] References Cited

U.S. PATENT DOCUMENTS

| | | | |
|---|---|---|---|
| 2,422,815 | 6/1947 | Davis | 34/82 |
| 2,575,876 | 11/1951 | Kausch | 183/60 |
| 2,611,192 | 9/1952 | Huebsch | 34/82 |
| 2,809,025 | 10/1957 | Pettyjohn | 34/82 |
| 2,886,900 | 5/1959 | Flannery | 34/82 |
| 2,902,834 | 9/1959 | Bosworth, Jr. et al. | 62/78 |
| 3,081,555 | 3/1963 | Stratman | 34/79 |
| 3,372,532 | 3/1968 | Campbell | 55/394 |
| 3,499,267 | 3/1970 | King et al. | 55/294 |
| 3,505,792 | 4/1970 | Dahlem | 55/294 |
| 3,555,785 | 1/1971 | Wooldridge et al. | 55/294 |
| 3,718,982 | 3/1973 | Deaton | 34/82 |
| 3,966,441 | 6/1976 | Freze | 55/290 |
| 4,294,597 | 10/1981 | Archer et al. | 55/283 |
| 4,314,409 | 2/1982 | Cartier et al. | 34/82 |
| 4,435,909 | 3/1984 | Williamson | 34/82 |
| 4,462,170 | 7/1984 | Burkall et al. | 34/82 |
| 4,519,222 | 5/1985 | Kannegiesser et al. | 34/82 |
| 4,538,361 | 9/1985 | Gresens | 55/294 |
| 4,557,058 | 12/1985 | Ozawa et al. | 34/133 |

*Primary Examiner*—Albert J. Makay
*Assistant Examiner*—David W. Westphal
*Attorney, Agent, or Firm*—Hill, Van Santen, Steadman & Simpson

[57] ABSTRACT

An air actuated lint removing system for cleaning lint filters in clothes dryers includes means for moving the lint filter and an air flow directing means with respect to one another to remove accumulated lint, and lint transporting means to move the lint to a lint collection reservoir.

9 Claims, 15 Drawing Figures

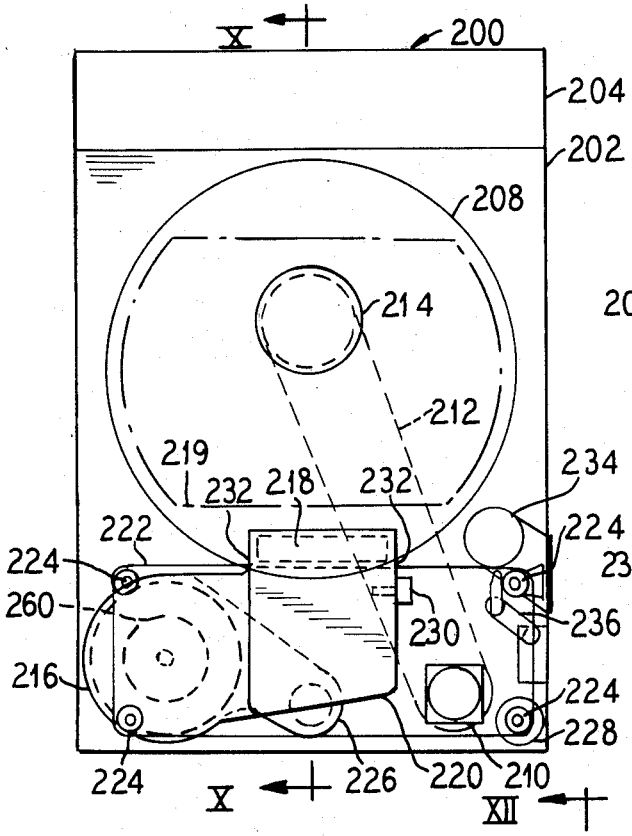
FIG. 9
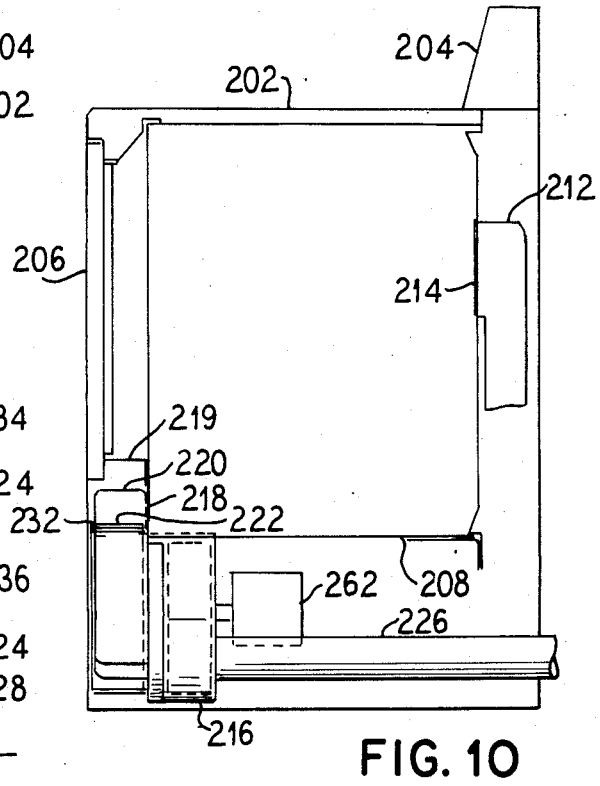
FIG. 10
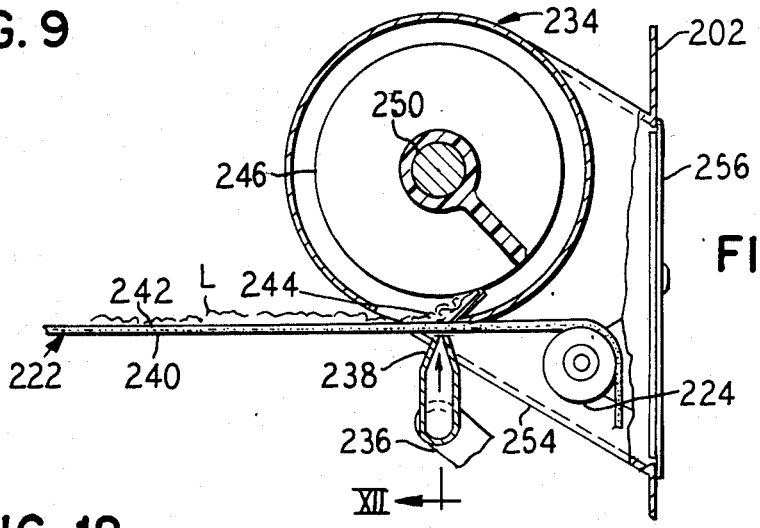
FIG. 11
FIG. 12
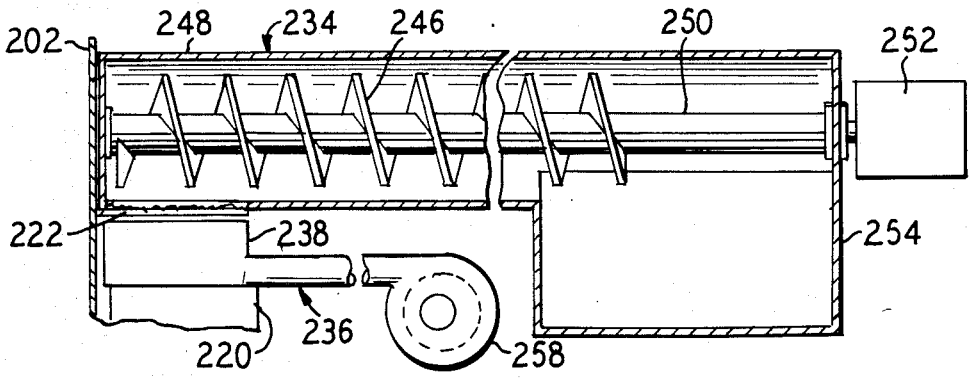

AIR ACTUATED AUTOMATIC LINT SCREEN CLEANING SYSTEM FOR DRYER

BACKGROUND OF THE INVENTION

1. Field of the Invention

The present invention relates generally to an automatic self-cleaning lint filter for use in a clothes dryer.

2. Description of the Prior Art

Removal of lint from a lint filter in a dryer has been accomplished as in Davis, Jr. U.S. Pat. No. 2,422,825 which discloses a delinting screen which uses air to remove lint from a lint filter in a clothes dryer. Means are included for reversing the air flow through the entire lint filter to blow lint off of the filter at the end of a drying operation. The Davis, Jr. lint filter is of a special construction and is formed of ribbon-like elements to prevent lint fibers from becoming wrapped around the screen elements.

Cartier et al U.S. Pat. No. 4,314,409 discloses an automatic lint screen cleaner and storage system for a dryer wherein a rotating cylindrical screen includes multiple wiper blades to roll lint deposited thereon into string-like masses and a rotating auger to capture and store the masses of lint.

Stratman U.S. Pat. No. 3,081,555 discloses a lint remover for a dryer including a mechanism for centrifugally separating lint from a main exhaust air stream of a dryer. A spiral motion is imparted on the air stream so that the denser lint will separate from the lighter air.

SUMMARY OF THE INVENTION

The present invention provides a device that automatically removes lint from a main lint filtering screen and stores the lint in a reservoir which need only be emptied after a relatively large number of dryer loads have been run. The present lint removal device eliminates clogging of the filter screen, has a minimum number of moving parts, cleans all portions of the lint screen uniformly, and fits into an existing dryer cabinet without requiring a decrease in dryer drum volume. It is quiet in operation, can be used in both axial and non-axial air flow dryers, and has a minimum of moving parts.

These and other advantages of the present invention are embodied in an automatic lint removal system in which a lint filtering screen and an air stream directing means for transmitting through the screen a relatively narrow air stream are relatively movable with respect to each other to thereby remove the lint from the screen. Means are also provided for collecting the removed lint and storing it in a reservoir. Several embodiments are disclosed, each using an air pressure differential, either positive or negative air pressure, to generate an air flow through portions of the lint filter screen in a direction opposite the dryer air flow. In a first and preferred embodiment, a circular lint filtering screen has a vacuum arm rotationally movable over a lint accumulating surface thereof. Lint from the screen is drawn into a shaped opening in the vacuum arm as it sweeps over the screen surface and is then drawn through a vacuum blower system and into a lint storage reservoir. The vacuum arm includes a beveled surface rotationally forward of the shaped opening to promote lint harvesting and a controlled air flow area through the vacuum arm to insure uniform removal of lint across the entire lint screen area. Recirculation of the lint vacuum air is also provided for increased energy efficiency.

In a second embodiment, the lint filtering screen is a movable belt that has a stationary lint gathering mechanism mounted adjacent one portion thereof. An air jet directs a stream of air through the screen to lift the lint, and a scraper and an auger disposed opposite the air jet abuts the lint accumulating surface of the lint screen to remove the lint. Once removed, the lint is moved by the auger to a lint reservoir. A sensor is provided to detect blockage of the lint screen for intermittent operation of the device.

In a third embodiment, a cylindrical lint filtering screen is rotatable to move portions of its surface past a stationary vacuum arm. The vacuum arm draws lint from the screen surface, after which the lint is forced by a blower into a filter bag within a lint reservoir. Sensors are provided for detecting blockage of the filter screen, as well as for detecting a full condition of the lint reservoir.

Each of the embodiments utilize a relatively restricted air stream to remove lint from a dryer lint filter, even twisted lint fibers that may have wrapped themselves around the screen wires. The air stream directing means and the filter in each embodiment are movable with respect to one another. Each embodiment uses an inexpensive mesh filter screen and, thus, avoids the use of specially constructed filters. The present invention also avoids the use of brushes or scrapers alone that wear out and that have a tendency to cause clogging of the screen. The present invention removes lint uniformly from the entire lint screen surface and stores the gathered lint so that a relatively large number of dryer loads may be run without emptying of the lint receptacle. Furthermore, the present lint removal devices provide quiet operation and are sufficiently compact to fit within existing dryers without loss of drying drum volume.

DESCRIPTION OF THE DRAWINGS

FIG. 9 is a front elevational view of a dryer including another embodiment of a self-cleaning lint remover according to the principles of the present invention;

FIG. 10 is a side elevation of the dryer shown in FIG. 9.

FIG. 11 is an enlarged cross-section of a lint gathering auger portion of the device shown in FIG. 9;

FIG. 12 is a cross-section of the device shown in FIG. 11 taken along lines XII—XII;

DESCRIPTION OF THE PREFERRED EMBODIMENTS

Figure 1:
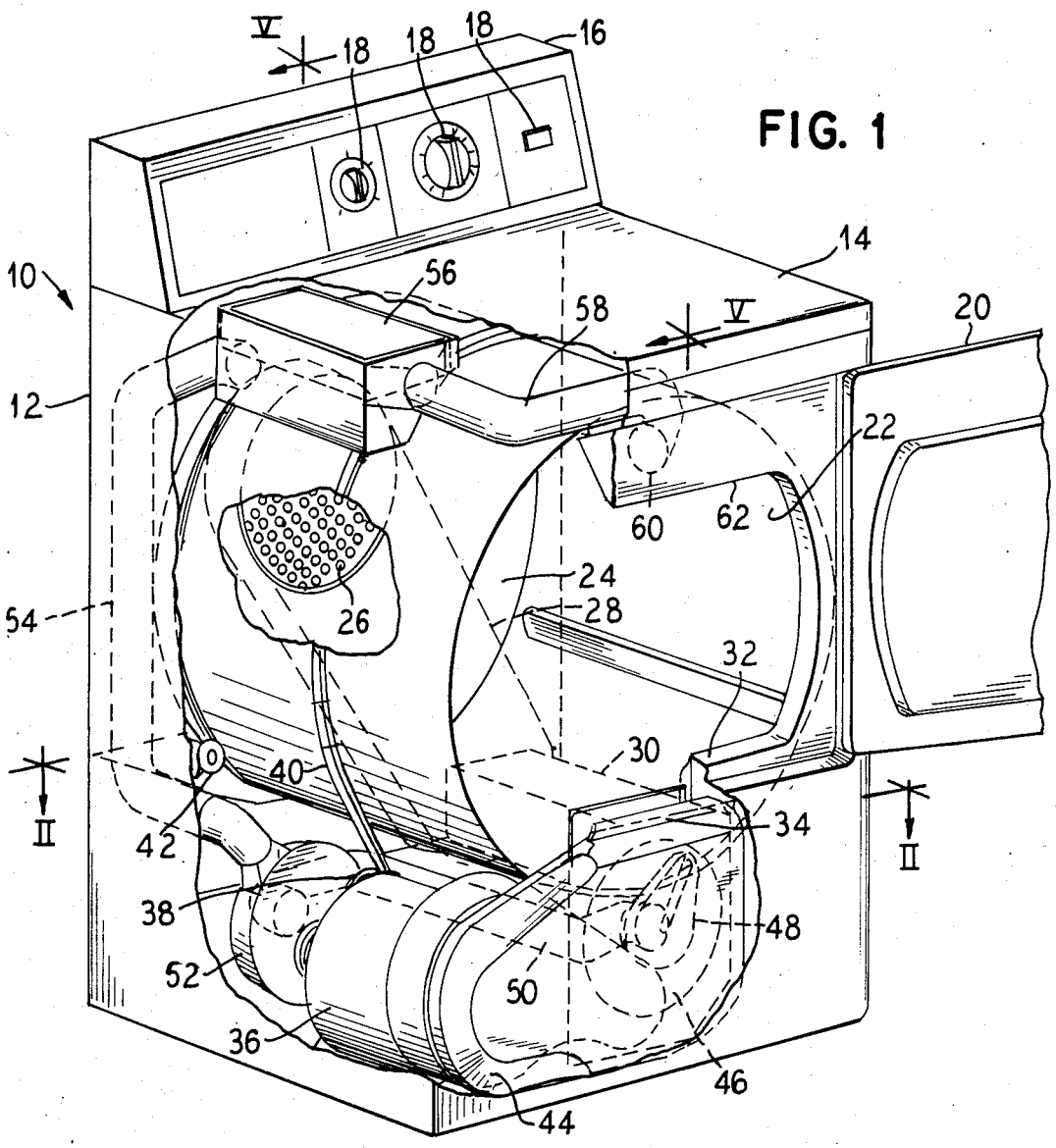
FIG. 1 is a perspective view of a dryer shown partially cut away to reveal a self-cleaning lint remover according to the principles of the present invention.

In FIG. 1, there is shown an automatic clothes dryer at 10 having an exterior cabinet 12 with a top panel 14 having a control console 16 along the rear portion thereof, incorporating a plurality of controls 18 for selecting an automatic programmed series of drying steps. The dryer cabinet 12 has a front openable door 20 providing access to the interior of a rotatable drying drum 22 which rotates about a horizontal axis and has a non-rotating rear bulkhead 24 with air inlets 26 connected by a hot air conduit 28 to a heater 30, as well as a non-rotating front bulkhead 32 having air outlets 34 therein for charging the interior of the drum 22 with heated air and for exhausting moisture laden air, respectively.

An electric motor 36 is provided to rotate the drum 22 through a pulley arrangement 38 and a belt 40, the drum 22 being rotated on a plurality of rollers 42. The motor 36 also drives the blower 44 which draws air through the air outlets 34 and through a lint screen 46, and thus provides air flow through the interior of the drum 22.

An automatic lint removal and accumulating system is provided for the lint filter screen 46 including a rotatable vacuum arm 48 connected to a horizontal lint conduit 50 leading to a lint system blower 52. Lint laden air is driven through a vertical lint conduit 54 to a lint reservior, or collection box, 56 where the lint is accumulated. The laden air is filtered and then exhausted from the lint reservior 56 through a return conduit 58 that is connected to an air return opening 60 in an upper front bulkhead 62.

Figure 2:
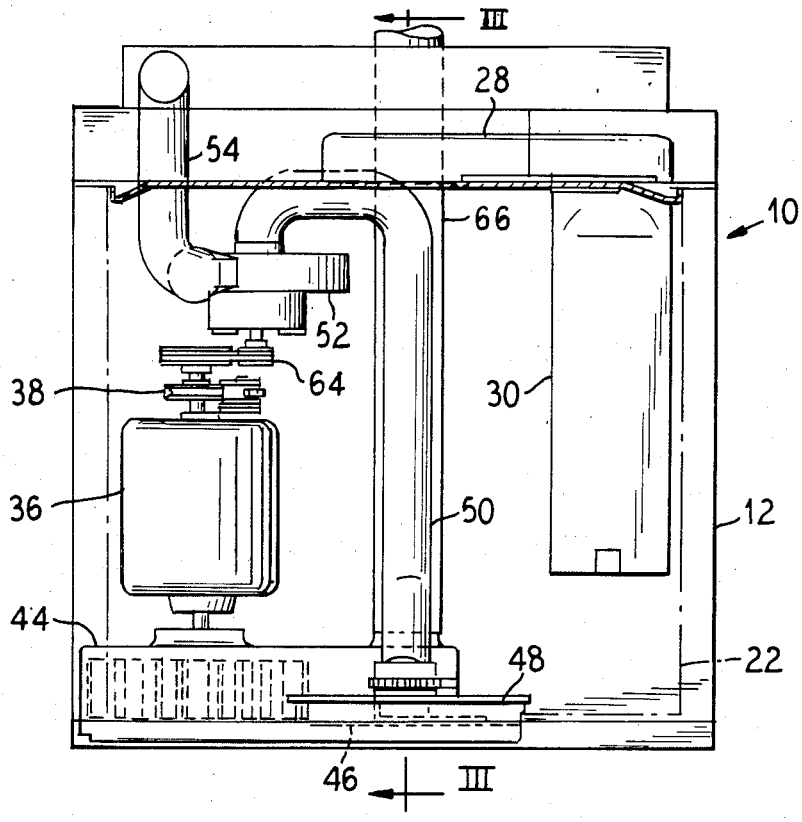
FIG. 2 is a cross-section of the device of FIG. 1 taken generally along lines II—II.

Referring to FIG. 2, the motor 36 not only drives the pulley arrangement 38 and the blower 44, but also, through a pulley arrangement 64, drives the lint blower 52 which moves the lint laden air through the lint removal and accumulating system. Thus, no additional motor is required to drive the lint blower 52. An exhaust duct 66 is connected to the main blower 44 through which moisture laden air is exhausted from the dryer 10 once the lint is removed.

Figure 3:
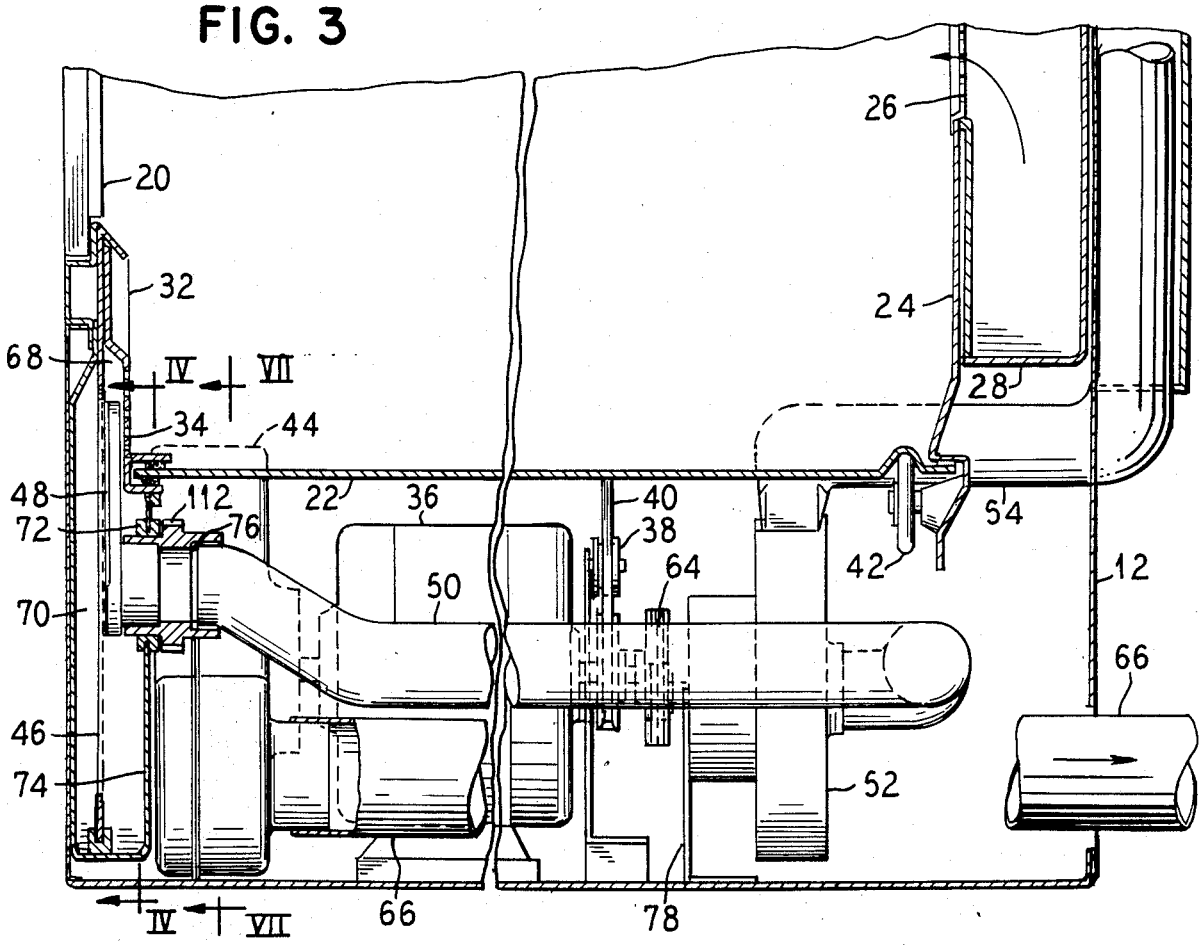
FIG. 3 is a cross-section of the device of FIG. 2 taken along lines III—III.

Heated air flows through the interior of the dryer drum 22, through the air outlets 34, and into a lint filtering compartment 68, in FIG. 3. The air is drawn by the blower 44 through the filter screen 46 into a filtered air portion 70 of the filtering compartment 68 which is downstream of the screen 46, depositing lint thereon. The rotatable vacuum arm 48 is held in close proximity to the screen 46 by a sleeve 72 mounted in a wall 74 of the filtering compartment 68. The vacuum arm 48 is also rotatably connected to the horiztonal lint conduit 50 by a gasket 76 which provides an air tight seal therebetween while still enabling the vacuum arm 48 to be rotated. The vacuum arm 48 is compact and occupies relatively little space in the filtering compartment 68.

The conduit 50 and the blower 52 are disposed beneath the dryer drum 20 and, thus, do not interfere with other dryer systems or require reduction of the dryer drum 22 size. The lint blower 52 is mounted to the dryer cabinet 12 by a bracket 78. In a preferred embodiment, the lint blower 52 includes a conventional mixed flow blower wheel of a four inch diameter that is operated at 6000 RPM to generate a 25 CFM flow into a 0" ($H_2O$) static head.

Figure 4:
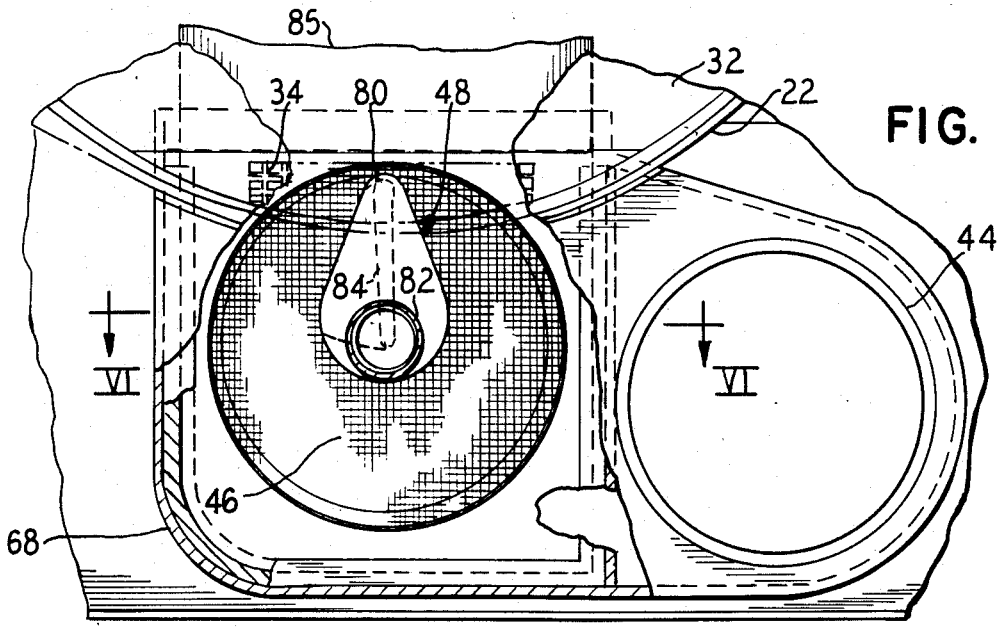
FIG. 4 is a partial cross-section of the device of FIG. 3 taken along lines IV—IV.

In FIG. 4, the filter screen 46 is circular-shaped and the vacuum arm 48 extends from a central portion thereof radially outward therefrom. The vacuum arm 48 rotates counterclockwise with respect to FIG. 4 so that a radially outward end 80 thereof sweeps the perimeter of the filter screen 46, thereby enabling the arm 48 to clean the entire screen 46. The vacuum arm 48 rotates about a cylindrical outlet 82 that is mounted in registration with the center of the screen 46 so that the lint on the screen 46 is drawn into a shaped opening 84 in the vacuum arm 48.

The air outlets 34 in the front dryer bulkhead 32 are shown more clearly in FIG. 4 leading into the filter compartment 68 through which lint laden air is drawn. The filter screen 46 is mounted in a frame 85 that extends upward into the front bulkhead 32 that is grasped for removal, such as during servicing. The filter screen 46 of the preferred embodiment is very fine, a 100 mesh, as opposed to the 50 mesh screen traditionally used on dryers. The present device, thus, provides improved lint removal over conventional lint filters.

Figure 5:
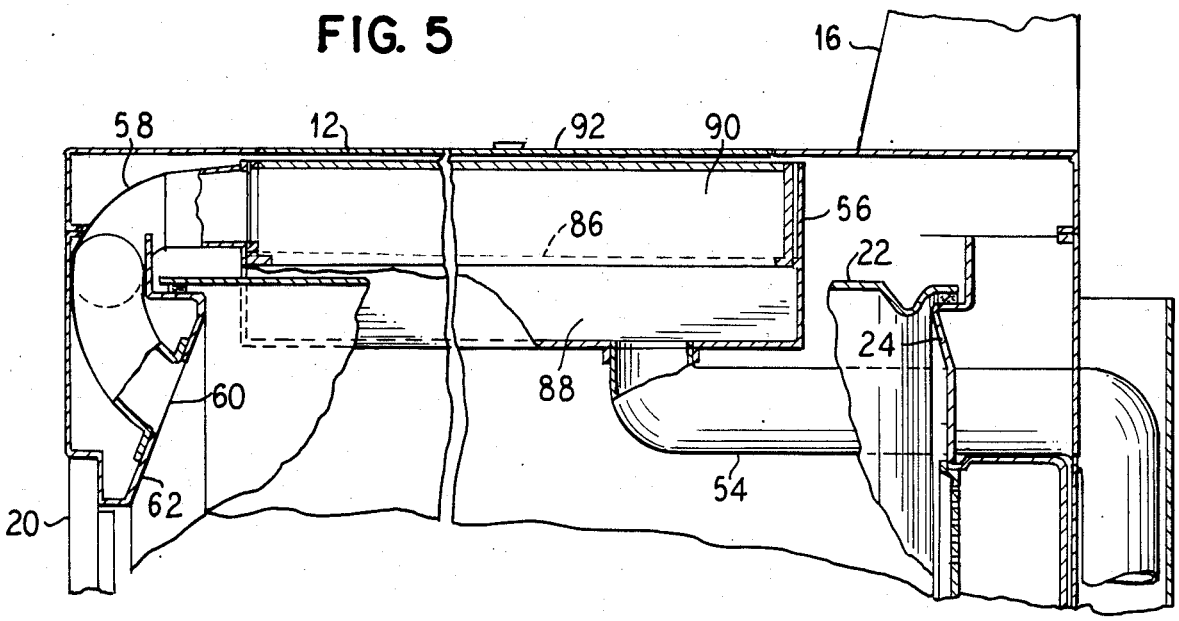
FIG. 5 is a partial cross-section of the upper portion of the dryer shown in FIG. 1 taken generally along lines V—V.

With reference to FIG. 5, air and accumulations of lint are forced upwardly through the vertical lint conduit 54 and into the lint reservoir 56 by the lint blower 52. The lint accumulations are filtered from the air by a horizontal filter element 86, preferably also of 100 mesh, mounted within the lint reservoir 56. Thus, quantities of lint accumulate in a lower portion 88 of the lint reservoir 56, while lint free air passes through the filter element 86 and into an upper portion 90 of the lint reservoir 56. The lint free air then passes through the return conduit 58, through the return opening 60 in the front upper bulkhead 62, and back into the interior of the dryer drum 22. The heated air which has passed through the lint collecting system is, thus, returned to the dryer compartment resulting in an increase in dryer efficiency and reducing heat loss.

A lint access door 92 is provided in the dryer cabinet 12 adjacent the lint reservoir 56 for removing lint therefrom once a quantity of lint has been accumulated. In the preferred embodiment, from approximately twelve to twenty dryer loads can be run before emptying of the reservoir 56 is required, as opposed to ordinary dryers in which the lint screen requires cleaning after every one or two loads.

Figure 6:
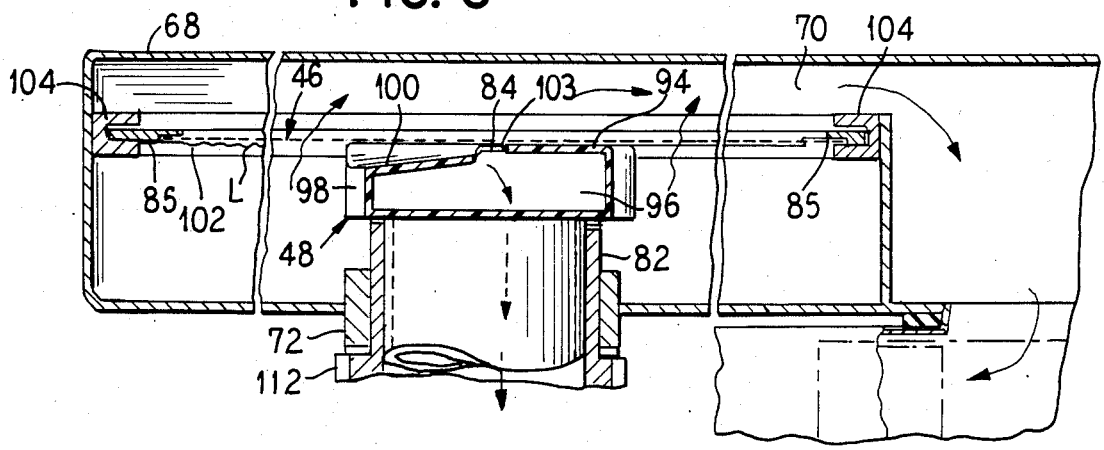
FIG. 6 is a cross-section of the device shown in FIG. 4 taken along lines VI—VI.

The vacuum arm 48 includes a screen engaging face 94 disposed adjacent the lint screen 46, as shown in FIG. 6. The opening 84 provides access to a hollow interior 96 of the vacuum arm 48 into which lint L is drawn, after which the lint moves through the cylindrical portion 82 and into the conduit 50. Between the opening 84 and a rotationally forward edge 98 of the arm 48 is a beveled surface 100 which enables lint L to be drawn into the opening 84 without first encountering the edge 98.

Also with reference to FIG. 6, lint L collects on a lint accumulating side 102 of the lint screen 46 as lint laden air is drawn therethrough within the filtering compartment 68, as indicated by the air flow arrows. The screen engaging face 94 of the vacuum arm 48 engages the lint accumulating surface 102 of the screen 46, and as the vacuum arm 48 rotates within the sleeve 72, the opening 84 passes over the lint accumulating surface 102. Negative air pressure generated by the lint system blower 52 creates an air stream that flows through the screen 46 and into the opening 84, drawing lint L from the screen surface 102. As the arm 48 rotates,an edge 103 of the opening 84 opposite the beveled surface 100 encounters any stubborn lint fibers which the air stream has failed to remove and helps to completely clean the screen 46 of lint L.

The filter screen 46 and the frame 85 in which it is mounted is preferably slidably mounted within the filter compartment 68 in screen slide rails 104 at either side thereof. The screen 46 is, thus, removable for replacement or cleaning by service personnel and the like.

Figure 7:
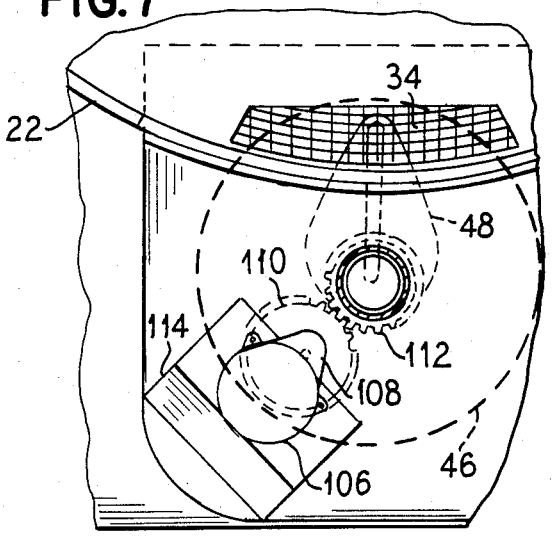
FIG. 7 is a cross-section of a similar portion to that of FIG. 4 and taken along lines VII—VII of FIG. 3.

In FIG. 7, the vacuum arm 48 is rotationally driven by a small motor 106. The rotational energy of the motor 106 is transmitted to vacuum arm 48 through a speed reduction mechanism 108 which drives a toothed gear 110. The toothed gear 110 engages a geared collar 112 that is fixedly connected to the cylindrical portion 82 of the vacuum arm 48. The vacuum arm motor 106 includes a mounting bracket 114 for connecting the motor to the dryer housing 12 or other convenient location. The motor 106 is preferably operated continuously during operation of the dryer 10, for example, at 6 RPM, or instead may be operated only at selected intervals when removal of the lint L from the screen 46 is required.

Figure 8:
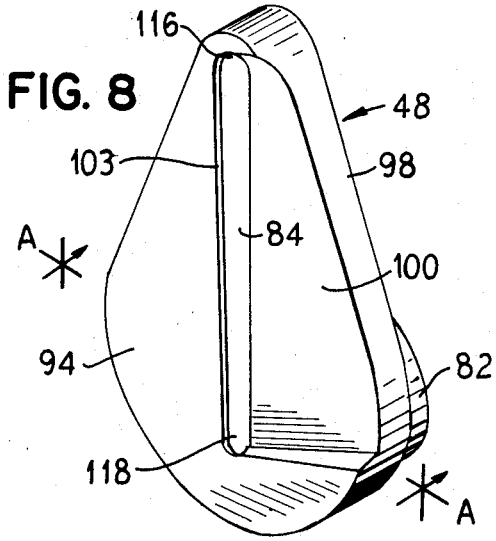
FIG. 8 is an enlarged perspective view of a vacuum arm according to the principles of the present invention.

FIG. 8 shows the vacuum arm 48 in more detail including the shaped opening 84, the screen engaging face 94, the beveled surface 100 and the cylindrical portion 82 about which the arm is rotated. The opening 84 is wider at a radially distant end 116 thereof than at a centrally disposed end 118, so that substantially uniform lint removal is accomplished along the length of the opening 84 irrespective of the distance from the cylindrical portion 82 through which the vacuum source is applied.

In a preferred embodiment, the end 116 is twice as wide as the end 118. Another important feature of the vacuum arm 48 is that the area of the slot 84 is less than the area of the maximum interior cross-section (taken normal to the dissection of air flow generally through lines A—A), and the maximum interior cross-section area is less than the area of the interior of the cylindrical outlet portion 82. This relationship guarantees that the maximum air velocity through the arm 48 is at the slot 84 for more effective lint removal.

It is also desired that the lint blower 52 be starved somewhat during operation. In a preferred embodiment, the vacuum arm 48 slot area is 1.33 in.$^2$, the maximum interior cross-sectional sectional area A—A is 1.85 in.$^2$, and the outlet area is 1.92 in.$^2$. The slot 84 is 4.75 in. in length and has an end 118 radius of 3/32 in. and an end 116 radius of 3/16 in.

The above-described embodiment of the present invention operates as follows:

As wet clothes within the dryer 10 are tumbled by the horizontally rotating drum 22 and are dried by heated air flowing into the air inlets 26, the clothes generate lint. Moist lint laden air from the clothes is drawn into the air outlets 34 by the operation of the blower 44, and, as the lint laden air passes through the filtering compartment 68, lint L is deposited on the screen 46 and lint-free moisture laden air is exhausted from the dryer 10 through the exhaust duct 66. During such dryer operation, the present invention is simultaneously removing lint from the lint screen 46 as it accumulates thereon.

The lint removal system preferably operates continuously during operation of the dryer; the vacuum arm 48 rotates about the face of the screen 46 and the lint blower 52 operates to generate an air pressure differential through the screen resulting in an air flow through the screen 46 and the lint system. Lint and air are drawn through the opening 84 from the lint accumulating surface 102, along the conduit 50, through the lint blower 52, up the vertical lint conduit 54 by positive air pressure and into the lint reservoir 56. There the lint is collected and the filtered air is returned to the dryer compartment by the return conduit 58.

In a second embodiment shown in FIG. 9, a dryer 200 includes a cabinet 202 having a console 204 and a door 206 for access to a rotatable dryer drum 208, the interior of which is heated by a heater 210 which supplies heat through a heat conduit 212 to hot air inlets 214. A blower 216 draws air through air outlets 218 in a stationary lower front bulkhead 219 and into a filter chamber 220. Unlike the first embodiment, however, the second embodiment includes an endless filter belt 222 extending over rollers 224. The belt 222 extends through the filter chamber 220 so that lint laden air passes therethrough for removing lint from the air. The filtered air then is drawn through the blower 216 and expelled through an exhaust 226, as in the first embodiment.

The belt 222 extends through the filter chamber 220 and is moved, such as by a motor 228 mounted to rotate one of the rollers 224, so that different segments of the belt 222 are moved within the filter chamber 220. Thus, as a segment of the belt 222 within the filter chamber 218 accumulates lint thereon, an adjacent lint-free segment of the belt 222 is moved into the filter chamber 218 by activation of the motor 228.

The belt 222 is preferably moved when a quantity of lint has been accumulated thereon as determined by a pressure differential between the air on either side of the belt 222. The pressure differential is detected by a pressure sensor 230 mounted in a wall of the filter chamber 220 below the belt 222. When the pressure sensor 230 detects a predetermined air pressure as a result of lint blocking the filter belt 222, it triggers activation of the belt motor 228, moving the belt in a clockwise direction with respect to FIG. 9.

A sealing means 232 is provided at the filter housing 220 where the filter belt 222 passes therethrough. The belt 222, in one embodiment, is wider than the filter housing 220, as shown in FIG. 10, and, thus, sealing means 232 is also provided extending along the filter housing 220 where the belt 222 extends therefrom. The belt 222 is, thus, easy to replace or service.

Referring again to FIG. 9 as well as to FIG. 11, lint L which has accumulated on the belt 222 is removed therefrom by an auger 234 in conjunction with a air flow means 236. The upper portion of the belt 222 moves to the right, as indicated, where it encounters a nozzle portion 238 of the air flow means 236 that directs a stream of air through the belt 222 from a side 240 opposite a lint accumulating side 242. The lint L is lifted somewhat from the belt 222 after which it encounters a scraper edge 244 which is mounted adjacent the belt 222. The lint L is lifted away from the filter screen belt 222 and toward an auger blade 246 of the auger 234. The spiral auger blade 246 is rotatably mounted within a cylindrical auger housing 248 on an auger shaft 250. In FIG. 12, the auger shaft 250 is rotatably driven by an auger motor 252 so that lint L is carried by the auger from the filter belt 222 at a first end of the auger 246 to a lint reservoir 254 at a second end of the auger 246. Once within the lint reservoir 254, the lint is periodically removed through an openable lint removal door 256 in the dryer cabinet 202 by an operator.

Positive pressure air is supplied to the nozzle 238 by a blower unit 258. Alternatively it is also possible to direct a portion of the exhaust air from the blower 216 to the nozzle 238 and, thus, eliminate the blower 258. Furthermore, a connecting linkage (not shown) may be provided between a main electric motor 260 and the auger 234 and/or a roller 224, so that a reduced number of motors may be used.

Figure 13:
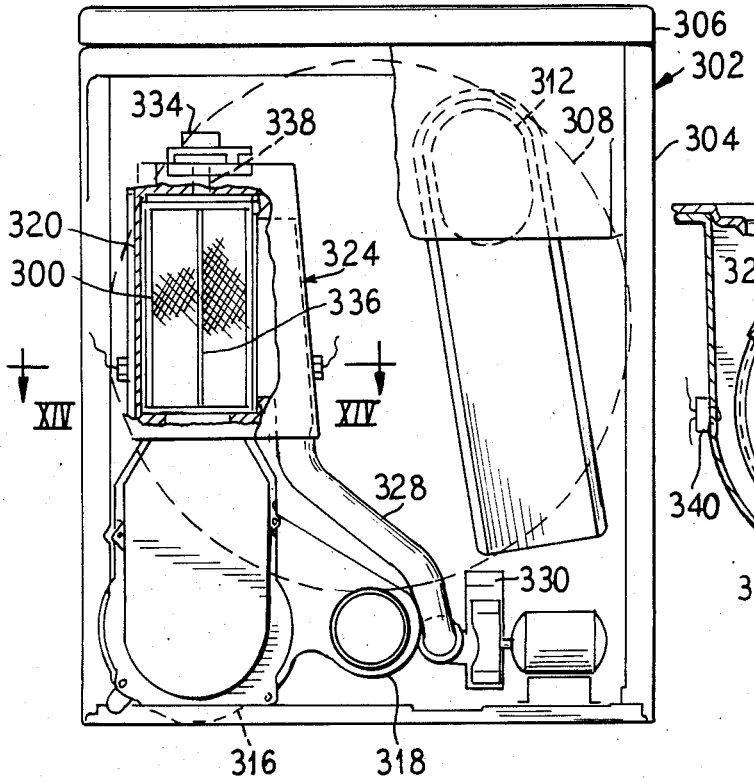
FIG. 13 is a rear elevational view of a dryer including another embodiment of a self-cleaning lint remover according to the principles of the present invention.
Figure 14:
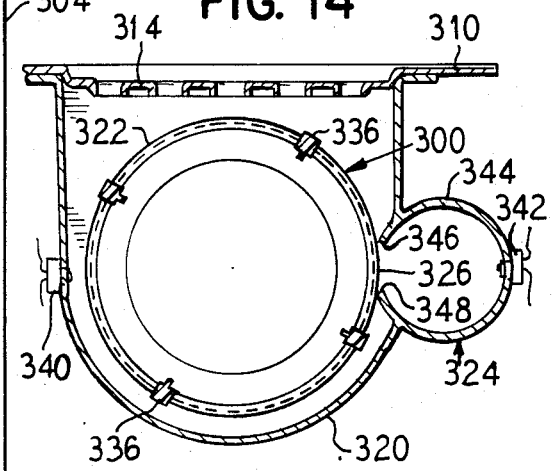
FIG. 14 is a cross-section of the device of FIG. 13 taken along lines XIV—XIV.
Figure 15:
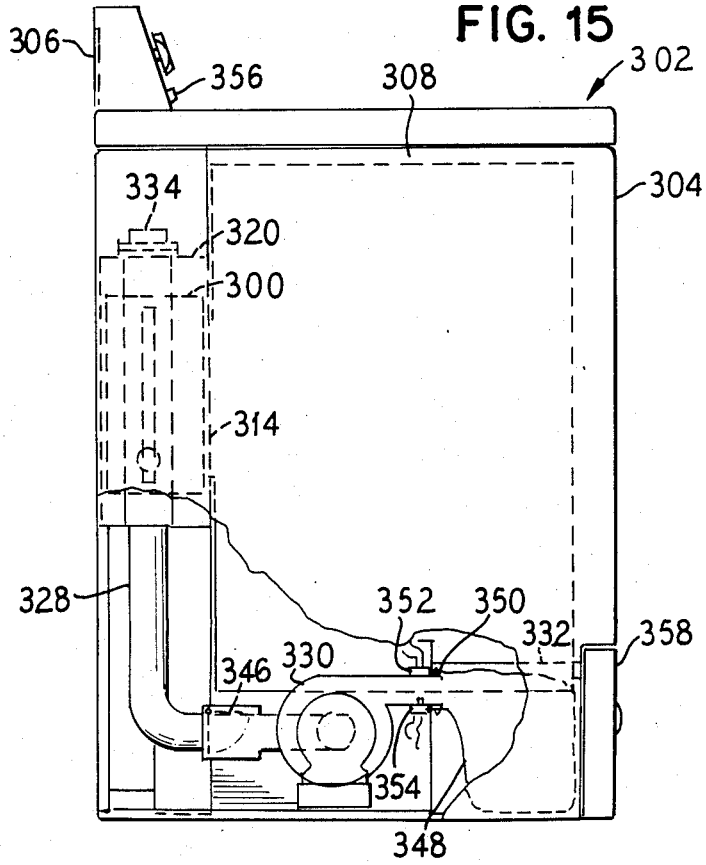
FIG. 15 is a side elevational view of the device of FIG. 13 shown partially cut away.

A third embodiment of the invention is shown in FIG. 13 and includes a filter drum 300 mounted for filtering lint laden air in a dryer 302. The dryer 302 includes a cabinet 304, a console 306, a rotatable drum 308 having a stationary rear bulkhead 310 with a hot air inlet 312 and an air outlet 314. A blower 316 draws lint and moisture laden air from the dryer drum 308 and forces it out an exhaust duct 318.

The cylindrical filter screen 300 is rotatably mounted within a filter compartment 320 adjacent the air outlets 314. Lint laden air passes through the air outlets 314, through the cylindrical filter screen 300, and to the blower 316 so that lint accumulates on an outer surface 322 of the filter cylinder 300. The lint accumulated on outer surface 322 is removed by a lint vacuum 324. The lint vacuum 324 includes an opening 326 extending adjacent the filter cylinder 300 along its length through which lint is drawn into a first lint conduit 328 by a lint blower 330. The lint blower 330 forces the lint and air into a lint reservoir 332. To insure that the entire surface of the filter cylinder 300 is cleaned by the lint vacuum 324, the filter cylinder 300 is rotatably driven by a motor 334 connected to the cylinder 300 along a vertical filter axis 338 and mounted atop the filter chamber 320. The filter cylinder 300 includes support members 336 for strength.

The lint vacuum 324 of the third embodiment is operated intermittently as the filter 300 becomes blocked by lint. Blockage of the filter screen 300 is determined by sensors, such as infrared or other optical sensors mounted to direct a beam of infrared light through the filter cylinder 300. Upon sensing a build-up of lint on the filter cylinder 300, the lint vacuum 324 and the motor 334 are activated to remove lint from the cylinder 300. It is also foreseen that the cylinder 300 could be rotated continuously during the operation of the dryer 302. In either case, lint encounters the opening 326 through which an air stream is flowing and is drawn thereby into the vacuum head 344. If desired, one of the spaced edges 346 and 348 of the opening 326 engages the lint collecting surface 322 of the cylinder 300 to provide scraping as well as air flow removal of the lint.

The lint removed from the filter cylinder 300 moves through the lint conduit 328 and through a one way valve 346 therein. The lint valve 346 is a simple check valve, and prevents air and lint from being drawn upward through the lint conduit 328 and toward the filter cylinder 300 when the lint blower 330 is not operating. After moving through the valve 346, the lint laden air moves through the blower 330 and into the lint reservoir 332.

The lint reservoir 332 in this embodiment includes a filter bag 348 with an opening connected over an outlet 350 of the blower 330. As lint accumulates within the lint reservoir 332, the filter bag 248 fills and when full the lint blocks the blower outlet 350. Blockage of the lint outlet 350 is sensed by a second pair of infrared or othe optical sensors which are mounted at the outlet 350.

The sensors 352 and 354 trigger an indicator, such as an indicator light 356 on the console 306, showing that the lint reservoir 332 is full. The lint reservoir 332 is then emptied through an openable door 358 in a lower front portion of the dryer cabinet 304. Thus, the lint contained within the filter bag 348 is easily removed and a new filter bag mounted within the filter reservoir 332.

Thus, there has been shown and described several embodiments of automatic lint removal systems for use in dryers, each having a lint filter screen which is cleaned of lint by a narrowly directed air stream flowing in the opposite direction of the lint depositing air flow so that lint is lifted therefrom. In each of the embodiments, the lint is moved into and stored within a lint reservoir which is emptyable by a user of the dryer. The lint removing portions and the lint filter screens of each of the devices move with respect to one another so that lint is harvested from only one portion of the screen at a time but the entire screen is eventually cleaned.

Many of the devices included additional features, such as sensors for detecting blockages of the lint screen, sensors for detecting a full condition of the lint reservior, recirculation of the heated air once the lint has been removed therefrom, and other important features.

As is apparent from the foregoing specification, the invention is susceptible to being embodied with various alterations and modifications which may differ particularly from those that we have described in the preceding specification and description. It should be understood that we wish to embody within the scope of the patent granted hereon all such modifications as reasonably and properly come within the scope of our contribution to the art.

The embodiments of the invention in which an exclusive property or privilege is claimed are defined as follows:

1. A method for cleaning a circular lint screen in a clothes dryer including a blower for generating a first air flow through said circular lint screen, comprising:

accumulating lint on a first side of said circular lint screen by said first air flow during operation of said dryer;

directing a restricted second air flow through said lint screen in a direction opposite to said first air flow to remove lint accumulated on said first screen side, said restricted second air flow being directed through a narrow radially extending region of said circular lint screen from substantially the center of said screen to adjacent the edge of said screen, said radially extending region through which said second air flow is directed being wider adjacent said edge of said screen than at said center of said screen;

moving said restricted second air flow rotationally relative to said lint screen to cause oppositely directed air flow through substantially all of said lint screen in a predetermined time period;

transporting lint removed from said lint screen to a lint reservoir; and storing lint that has been transported within said lint reservoir.

2. An automatic lint removal system for use in an automatic clothes dryer having a lint collecting screen on which lint particles are accumulated during operation of said dryer, comprising:

means for generating a negative air pressure differential across said screen to cause air flow through said lint collecting screen to effect removal of said accumulated lint particles;

means for directing the air flow caused by said pressure differential generating means, said directing means including a vacuum arm defining an opening adjacent the lint collecting screen;

means for moving said air flow directing means with respect to said lint screen to direct said air flow through substantially all of said lint screen in a predetermined interval;

means for transporting lint particles removed from said lint collecting screen;

a lint storage reservoir into which lint particles removed from said lint screen are deposited by said lint transporting means; and an optical sensor mounted at said lint storage reservoir and connected to determine when said lint storage reservoir becomes full.

3. An automatic lint removal system for use in an automatic clothes dryer having a circular lint collecting screen on which lint particles are accumulated by an air flow in a first direction during operation of said dryer, comprising:

means for generating an air pressure differential across said screen to cause a negative air flow in a second direction opposite to said first direction through said lint collecting screen to effect removal of said accumulated lint particles;

means for directing said negative air flow caused by said pressure differential generating means, said directing means including a vacuum arm defining an opening adjacent said lint collecting screen and having a cylindrical mounting sleeve;

means for moving said directing means with respect to said lint screen to direct said negative air flow through substantially all of said lint screen in a predetermined interval, said moving means including:

a selectively operating motor; and a linkage connected between said motor and said vacuum arm to enable said motor to rotate said vacuum arm when said motor is operated, said linkage including a geared bushing around said cylindrical mounting sleeve of said vacuum arm and a speed reduction mechanism connected between said motor and said geared bushing to transmit the rotational energy of said motor to said vacuum arm;

means for transporting lint particles removed from said lint collecting screen; and a lint storage reservoir into which lint particles removed from said lint screen are deposited by said lint transporting means.

4. A system as claimed in claim 3, wherein an air flow cross-section area at said opening is less than an air flow cross-section area at an interior of said vacuum arm, and said interior arm flow cross-section area is less than an air flow cross-section area at an outlet of said vacuum arm.

5. An automatic lint removal system for use in an automatic clothes dryer having a lint collecting screen on which lint particles are accumulated during operation of said dryer, comprising:

means for generating an air pressure differential across said screen to cause air flow through said lint collecting screen to effect removal of said accumulated lint particles;

means for moving said air pressure differential generating means with respect to said lint screen to direct said air flow through substantially all of said lint screen in a predetermined interval;

means for transporting lint particles removed from said lint collecting screen;

a lint storage reservoir into which lint particles removed from said lint screen are deposited by said lint transporting means;

said pressure differential generating means generating a negative air pressure at a surface portion of said lint collecting screen;

means disposed adjacent a lint collecting side of said lint collecting screen for directing the air flow caused by said negative air pressure, said air flow directing means defining an opening adjacent said lint collecting screen;

said pressure differential generating means including a vacuum blower and a lint conduit in communication with said vacuum blower;

said air flow directing means including a vacuum arm in communication with said lint conduit, said vacuum arm being selectively movable and mounted for rotation in said dryer adjacent said lint collecting screen;

said lint collecting screen being stationary and substantially circular in shape; and a screen engaging face of said vacuum arm including a beveled surface extending adjacent a first rotationally directed side of said opening.

6. An automatic lint removal system for use in an automatic clothes dryer having a lint collecting screen on which lint particles are accumulated during operation of said dryer, comprising:

means for generating an air pressure differential across said screen to cause air flow through said lint collecting screen to effect removal of said accumulated lint particles;

means for moving said air pressure differential generating means with respect to said lint screen to direct said air flow through substantially all of said lint screen in a predetermined interval;

means for transporting lint particles removed from said lint collecting screen;

a lint storage reservoir into which lint particles removed from said lint screen are deposited by said lint transporting means;

said pressure differential generating means generating a negative air pressure at a surface portion of said lint collecting screen;

means disposed adjacent a lint collecting side of said lint collecting screen for directing the air flow caused by said negative air pressure, said air flow directing means defining an opening adjacent said lint collecting screen;

said pressure differential generating means including a vacuum blower and a lint conduit in communication with said vacuum blower;

said air flow directing means including a vacuum arm in communication with said lint conduit, said vacuum arm being selectively movable and mounted for rotation in said dryer adjacent said lint collecting screen;

said lint collecting screen being stationary and substantially circular in shape; and said opening being wider at a radially distant end than at a centrally disposed end.

7. In a fabric dryer having a drum for tumbling a fabric load and a blower for circulating heated air through said load to an air discharge passage and for defining a first air flow direction, a lint screen cleaning and lint storage device, comprising:

a removable circular filter screen mounted in said air discharge passage for accumulating lint on a first lint collecting surface;

a vacuum arm having a face mounted adjacent said first screen surface, said face defining a shaped opening through which lint is drawn from said first screen surface, one end of said vacuum arm extending adjacent an edge of said circular filter screen and a portion of said vacuum arm being disposed adjacent a center of said circular filter screen, said centrally disposed portion including a vacuum arm outlet;

a motor connected to rotate said vacuum arm to move said one vacuum arm end along the edge of said circular filter screen;

a lint conduit having at a first end connected in communication with said vacuum arm outlet;

a lint blower in communication with a second opposite end of said lint conduit and operable to draw air and lint through said vacuum arm opening and said lint conduit;

a lint storage reservoir in communication with said vacuum blower into which lint and air are blown;

a selectively openable access means in said lint storage reservoir for removing lint from said reservoir; and a second filter mounted within said lint storage reservoir for retaining lint within said reservoir said opening extending from said one end of said arm to said centrally disposed portion of said vacuum arm and said opening being wider at said one end than at said centrally disposed portion.

8. An automatic lint remover for use in a fabric dryer having a blower for generating an outlet air stream in a first direction, comprising:

a continuous belt filter screen mounted for movement past said outlet air stream to accumulate lint on a first side of said belt filter screen;

a stationary air nozzle mounted to direct an air jet through said continuous belt filter screen in a second direction opposite to said first direction to separate lint from said filter screen;

means for removing lint from said filter screen mounted at said first side of said filter screen, said removing means being mounted opposite said air nozzle in the flow path of said air jet, said removing means including:

a scaper adjacent said filter screen, a rotatable auger mounted adjacent said scraper to engage lint scraped from said filter screen, and means for rotating said auger;

a motor coupled to move said continuous belt filter screen past said nozzle;

a pressure sensor mounted to detect a predetermined pressure drop across said filter screen at said outlet air stream to trigger operation of said motor;

a lint storage reservoir in communication with said rotatable auger into which lint is carried by said auger; and an openable door providing access to said lint storage reservoir through which accumulated lint is removed.

9. An automatic lint removing and collecting apparatus for use in an automatic fabric dryer having an outlet duct from a dryer compartment through which lint laden air passes, comprising:

a rotatable cylindrical filter screen mounted at said outlet duct to filter lint from lint laden air onto an exterior surface of said cylindrical filter screen;

a vacuum arm fixedly mounted adjacent said exterior surface of said filter screen and defining an opening extending along the length of said cylindrical screen through which lint is drawn;

a motor connected to rotate said cylindrical filter screen about a longitudinal axis;

a vacuum blower having an input in communication with said vacuum arm and being operable to generate an air flow into said opening;

a lint storage reservoir in communication with an output of said vacuum blower into which lint is blown by said blower;

a filter bag disposed within said lint storage reservoir and connected to said output of said vacuum blower to retain lint blown into said lint storage reservoir by said vacuum blower;

a first sensing means mounted for sensing when the lint retained in said filter bag has filled said filter bag; and a second sensing means for sensing lint build-up on said filter screen by transmitting a signal through said filter, said second sensing means connected to initiate operation of said vacuum blower and said screen motor upon sensing a predetermined build-up of lint on said filter screen.

* * * * *